US011370576B1

(12) United States Patent
Bevier

(10) Patent No.: US 11,370,576 B1
(45) Date of Patent: Jun. 28, 2022

(54) STRADDLE FLANGE TOP SEAL PUNNET

(71) Applicant: INTERNATIONAL PAPER COMPANY, Memphis, TN (US)

(72) Inventor: Alex Dean Bevier, Fresno, CA (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 17/162,938

(22) Filed: Jan. 29, 2021

(51) Int. Cl.
*B65D 5/24* (2006.01)
*B65D 5/42* (2006.01)

(52) U.S. Cl.
CPC ..... *B65D 5/243* (2013.01); *B65D 5/4266* (2013.01); *B65D 5/4295* (2013.01)

(58) Field of Classification Search
CPC .... B65D 5/243; B65D 5/4266; B65D 5/4295; B65D 5/2047; B65D 5/0015; B65D 5/246; B65D 5/003; B65D 5/241
USPC ..... 229/120, 174, 178, 169, 915, 160, 916, 229/113, 125.27, 114; 206/509, 519
See application file for complete search history.

(56) References Cited

U.S. PATENT DOCUMENTS

| | | | | |
|---|---|---|---|---|
| 2,450,110 A | | 9/1948 | Brooks | |
| 2,577,305 A | | 12/1951 | Brooks | |
| 2,750,094 A | | 6/1956 | McGill | |
| 3,917,155 A | * | 11/1975 | Bemiss | B65D 5/2052 229/169 |
| 4,114,797 A | * | 9/1978 | Manizza | B65D 5/247 229/188 |
| 4,722,474 A | | 2/1988 | Dropsy | |
| 4,836,439 A | | 6/1989 | Hart | |
| 4,998,669 A | * | 3/1991 | Karolyi | B65D 5/2047 229/169 |
| 5,163,609 A | * | 11/1992 | Muise, Jr. | B65D 5/003 229/113 |
| 5,433,374 A | * | 7/1995 | Forbes, Jr. | B65D 5/2047 229/123.2 |
| 6,505,769 B2 | * | 1/2003 | Stone | B65D 5/2047 229/125.35 |
| 8,800,850 B2 | * | 8/2014 | MacLeod | B65D 5/003 229/109 |
| 2020/0180814 A1 | * | 6/2020 | Timpson | B65D 5/243 |

FOREIGN PATENT DOCUMENTS

| | | |
|---|---|---|
| FR | 3064249 | 8/2018 |
| JP | 2015174661 A | 10/2015 |
| SE | 395430 B | 8/1977 |
| SE | 412356 B | 3/1980 |
| WO | WO-2017055682 | 4/2017 |

* cited by examiner

*Primary Examiner* — Christopher R Demeree
(74) *Attorney, Agent, or Firm* — Michael D. Folkerts; Thomas W. Ryan

(57) ABSTRACT

A container comprising a bottom panel defining a base of the container, and a plurality of side walls extending from the bottom panel and defining an interior area of the container, wherein the plurality of side walls include at least opposing first and second side walls. A first flange structure is connected to each of the first and second side walls along respective fold lines at an upper edge of the container. Each first flange structure straddles a respective side wall and comprises an inner flange portion extending over the interior area of the container, and an outer flange portion, coplanar with the inner flange portion, extending away from the interior of the container, wherein the outer flange portion is defined by one or more tabs.

16 Claims, 3 Drawing Sheets

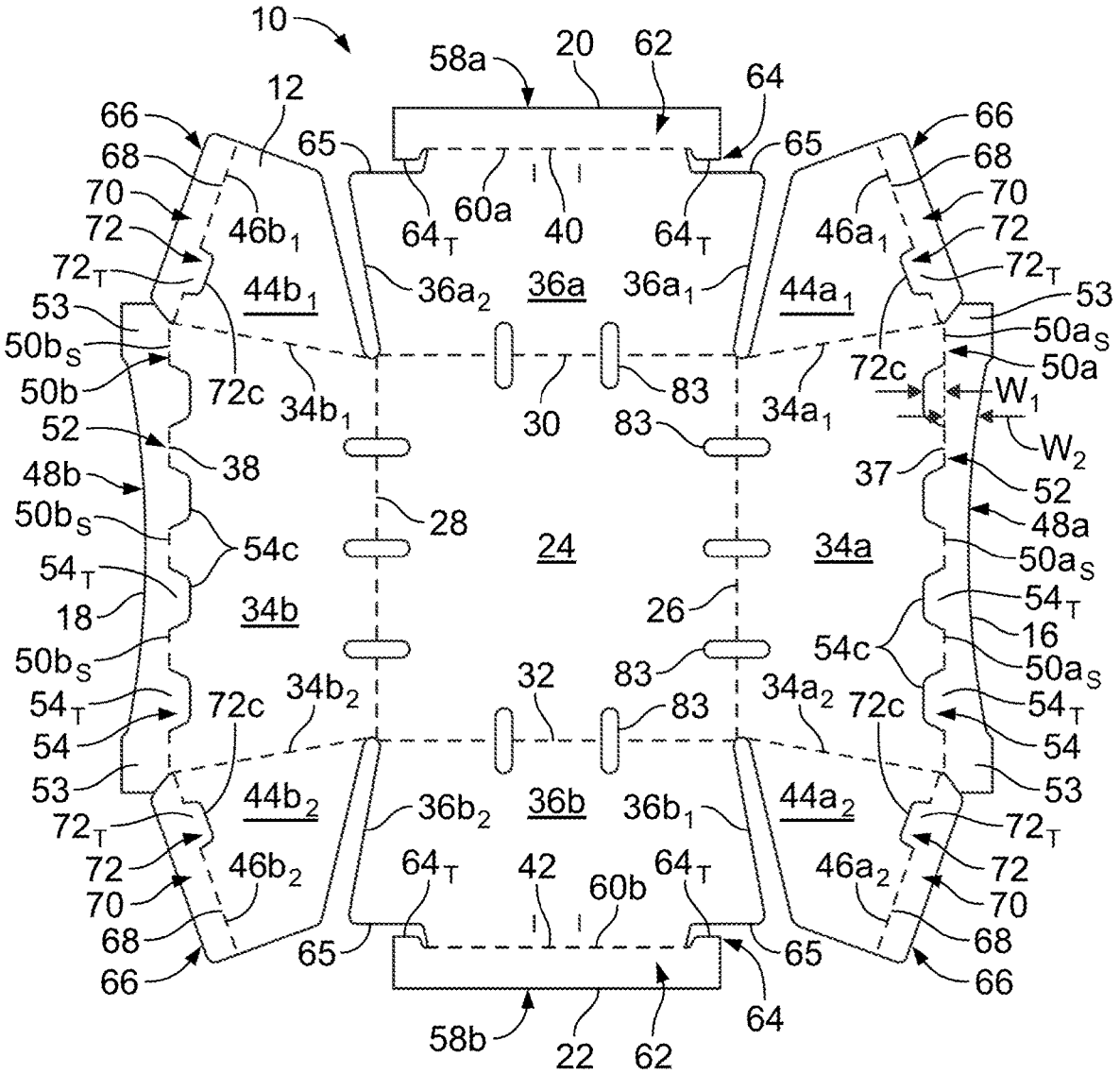
FIG. 1
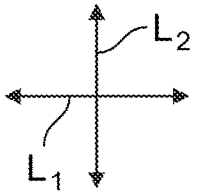

STRADDLE FLANGE TOP SEAL PUNNET

FIELD OF THE INVENTION

The present disclosure relates generally to containers for receiving a product and, in particular, to a container having a flange structure at an upper edge of the container for receiving a seal to enclose the contents of the container.

BACKGROUND OF THE INVENTION

Punnet trays or containers are well known to the industry for single use products, such as to package products such as, for example, fresh fruits and vegetables for retail distribution. The tray can generally comprise a bottom panel and a plurality of side wall panels that extend upwardly and slightly outwardly from the bottom panel so that a plurality of trays may be stacked in nested relation to each other to minimize or reduce the overall volume occupied by a package or group of such trays.

Conventionally, punnet trays may be formed of a plastic material wherein the trays can be formed with flanges for receiving a thin heat sealed film that may be transparent for visual presentation of the product. While forming the trays of a plastic materials permits the trays to be formed to a particular configuration, it is desirable to reduce the amount of plastic in such packaging. As an alternative form of packaging, trays can be formed of a fiber based material, such as a paperboard material, wherein the trays can be formed from a single sheet of material as a folded and glued tray. However, the replacement of moldable plastic trays with die cut and folded sheets presents various challenges when the sealing method requires a flange that is in plane with the seal. Plastic trays can easily form very small flanges on the top of the tray that project outward to support the tray with a clamping system that then heat seals the film to the top of the tray that is filled with product.

These flanges can be quite small, and often do not exceeding 5 mm in width, such that formation of these flanges has not been practical for materials that are folded rather than molded. Further, outwardly folded flanges may not be not sufficiently rigid to resist pivoting of the flange relative to the side walls of the container following a sealing operation, such that outwardly folded flanges on opposing walls of the container may pivot toward each other with a resulting loss of tension on the sealing film, resulting in a less attractive appearance of the sealing film.

SUMMARY OF THE INVENTION

In accordance with an aspect of the disclosure, a container is provided comprising \a bottom panel defining a base of the container, and a plurality of side walls extending from the bottom panel and defining an interior area of the container, wherein the plurality of side walls include at least opposing first and second side walls. An upper edge of the container is defined by edges of the plurality of the side walls distal from the bottom panel. A first flange structure is connected to each of the first and second side walls along respective fold lines at the upper edge of the container. Each first flange structure straddles a respective side wall and comprises an inner flange portion extending over the interior area of the container, and an outer flange portion, coplanar with the inner flange portion, extending away from the interior of the container. The outer flange portion is defined by one or more tabs having a length dimension, parallel to the first and second side walls, that is less than a length dimension of the inner flange portion.

Each inner flange portion can include a first edge hingedly attached to a respective one of the first and second side walls at two or more spaced fold line segments defining the fold lines, and a second edge extending continuously along the length of the first flange structure and located over the interior area of the container.

The one or more tabs can extend from the first edge of the inner flange portion at locations between the fold line segments.

Each inner flange portion can have a width dimension, extending in a transverse direction perpendicular to the first and second side walls, that is greater than a width dimension of the outer flange portion, extending in the transverse direction.

The plurality of side walls can further include opposing third and fourth side walls extending between the first and second side walls, and a second flange structure can be hingedly attached to each of the third and fourth side walls at the upper edge of the container, each second flange structure including an inner flange portion extending over the interior area of the container.

Each second flange structure can further include an outer flange portion extending away from the interior area of the container.

The outer flange portions of the second flange structures can each comprise tabs that extend away from the interior area of the container and that have a length dimension parallel to the third and fourth side walls that is less than a length dimension of the first flange portions.

Connection flaps can be hingedly connected to opposing lateral sides of each of the first and second side walls at fold lines and adhered to respective ones of the third and fourth side walls, and a support flange can be hingedly connected to each of the connection flaps and engaged under a respective inner flange portion of one of the second flange structures.

Each support flange can include a tab extending away from the interior area of the container and engaged under a respective outer flange portion of one of the second flange structures.

The first flange structures can include lateral extensions that are engaged over a respective support flange.

In a accordance with another aspect of the disclosure, a container is provided formed of a unitary blank of semi-rigid material. The container comprises a bottom panel defining a base of the container, and a plurality of side walls comprising opposing first and second side walls connected to the bottom panel and opposing third and fourth side walls connected to the bottom panel. An upper edge of the container is defined by edges of the plurality of the side walls distal from the bottom panel. A first flange structure is connected to each of the first and second side walls along respective fold lines at the upper edge of the container. A second flange structure is connected to each of the third and fourth side walls along respective fold lines at the upper edge of the container. Each of the first and second flange structures straddle a respective side wall and comprise an inner flange portion extending over the interior area of the container, and an outer flange portion, coplanar with the inner flange portion, extending away from the interior of the container.

The outer flange portion of each of the first and second flange structures can be defined by one or more tabs having a length dimension, parallel to a respective side wall, that is less than a length dimension of the inner flange portion.

The inner flange portion of each of the first and second flange structures can be defined by a continuous flange extending between opposing side edges of a respective side wall.

One or more vent openings can be formed in the first and second side walls, wherein each vent opening is formed by a cut line defining a respective tab that is separated from a respective first and second side wall during a pivoting of the first and second flange structures to a position perpendicular to the first and second side walls.

Connection flaps can be hingedly connected to opposing lateral sides of each of the first and second side walls at fold lines and adhered to respective ones of the third and fourth side walls, and a support flange can be hingedly connected to each of the connection flaps and engaged under both one of the first flange structures and one of the second flange structures.

An upper surface of the first flange structure can be coplanar with an upper surface of the second flange structure.

In accordance with a further aspect of the disclosure, a blank for forming a container is provided. The blank comprises a bottom panel a having opposing longitudinal edges, and opposing lateral edges. A pair of first side panels are hingedly connected to the bottom panel at the longitudinal edges, and a pair of second side panels are hingedly connected to the bottom panel at the lateral edges. A first flange structure is hingedly connected to each of the first side panels at respective first flange fold lines, each first flange fold line comprising a discontinuous fold line defined by two or more fold line segments. Each first flange structure includes a first flange portion extending to one side of the first flange fold line and a second flange portion extending to an opposite side of the first flange fold line. A second flange structure is hingedly connected to each of the second side panels at respective second flange line fold lines. Each second flange structure includes a first flange portion extending to one side of the second flange fold line and a second flange portion extending to an opposite side of the second flange fold line.

The first flange portion of the first flange structure can be continuous extending between opposing sides of a respective first side panel.

The second flange portion of the first flange structure can comprise at least one cut line defined in each of the first side panels and spanning between adjacent fold line segments to define at least one tab integral with the first flange portion of the first flange structure.

Cut lines can be defined in each of the first side panels and spanning between each of a plurality of adjacent fold line segments to define a plurality of tabs integral with the first flange portion of the first flange structure.

The first flange portion of the second flange structure can be continuous extending along the second flange fold line, and the second flange portion of the second flange structure can comprise tabs located at opposing ends of the first flange portion of the second flange structure, the tabs extending from the second flange fold line toward a respective second side panel.

Connection flaps can be hingedly connected to opposing sides of each of the first side panels at fold lines, and a support flange can be hingedly connected to each of the connection flaps at a support flange fold line.

Each support flange fold line can include an end adjacent to an end of a first flange fold line, and each support flange can comprise a first portion extending along the support flange fold line outward from the connection flap, and a second flange portion comprising at least one tab defined by a cut line in the connection flap and integral with the first flange portion of the support flange.

Each of the first side panels can include opposing sides that diverge extending in a direction from the bottom panel, and each of the second side panels can include opposing sides that diverge extending in a direction from the bottom panel.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

FIG. 1 is a plan view of a blank for use in forming a container as described herein;

DETAILED DESCRIPTION OF THE INVENTION

Figure 2:
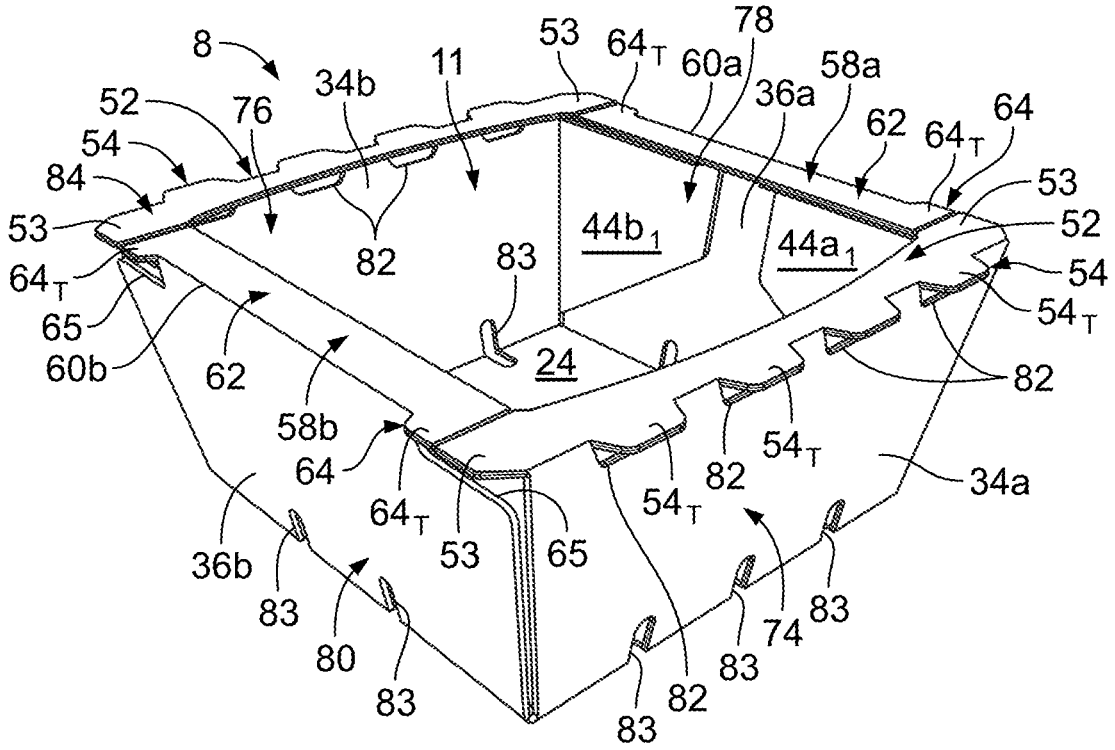
FIG. 2 is a top perspective view of a container formed from the blank of FIG. 1.

In the following detailed description of the preferred embodiment, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Referring to FIG. 1, a die cut blank 10 is shown for illustrating one or more aspects of a container or tray comprising features for providing a sealing flange on at least a portion of a periphery of the container or tray. The particular blank 10 illustrated herein comprises a one-piece blank of sheet material that can be used to form a container 8, see FIG. 2. The blank 10 may be formed of a corrugated paperboard material having an interior portion or layer defined by elongated flutes, as is generally known in the art, and may be die cut to the shape shown herein, although other materials and variations of the illustrated shape may be provided within the scope of the blank and container described herein, including other forms of fiber-based materials, e.g., other forms of paperboard such as cardboard and coated paperboard, and may also generally include semi-rigid materials that can be scored and folded. The blank 10 illustrated in FIG. 1 is a planar piece of material in which an inner side 12 is shown facing out of the page and an outer side 14, see FIG. 2, faces in an opposite direction from the inner side 12.

As seen in FIG. 1, the blank 10 extends in a longitudinal direction $L_1$ between first and second longitudinal ends, generally designated 16 and 18, respectively, and further extends in a lateral direction $L_2$, perpendicular to the longitudinal direction $L_1$, between first and second lateral ends, generally designated 20 and 22, respectively.

The blank 10 comprises a bottom panel 24 having a generally rectangular shape including opposing longitudinal edges 26, 28, and opposing lateral edges, 30, 32 connecting the longitudinal edges 26, 28. A pair of first side panels 34*a*, 34*b* are hingedly connected to the bottom panel 24 at respective longitudinal edges 26, 28. The first side panel 34*a* includes a pair of opposing side edges $\mathbf{34}a_1$, $\mathbf{34}a_2$ that can diverge from each other in a direction from the bottom panel 24 toward an outer edge 37 of the first side panel 34*a*. Similarly, the first side panel 34*b* includes a pair of opposing side edges $\mathbf{34}b_1$, $\mathbf{34}b_2$ that can diverge from each other in a direction from the bottom panel 24 toward an outer edge 38 of the first side panel 34*b*.

A pair of second side panels 36*a*, 36*b* are hingedly connected to the bottom panel 24 at respective lateral edges 30, 32. The second side panel 36*a* includes a pair of opposing side edges $\mathbf{36}a_1$, $\mathbf{36}a_2$ that can diverge from each other in a direction from the bottom panel 24 toward an outer edge 40 of the second side panel 36*a*. Similarly, the second side panel 36*b* includes a pair of opposing side edges $\mathbf{36}b_1$, $\mathbf{36}b_2$ that can diverge from each other in a direction from the bottom panel 24 toward an outer edge 42 of the second side panel 36*b*.

It should be understood that, although the pair of first side panels 34*a*, 34*b* are described with diverging edges $\mathbf{34}a_1$, $\mathbf{34}a_2$, $\mathbf{34}b_1$, $\mathbf{34}b_2$, and the second pair of side panels 36*a*, 36*b* are described with diverging edges $\mathbf{36}a_1$, $\mathbf{36}a_2$, $\mathbf{36}b_1$, $\mathbf{36}b_2$, the present disclosure is not limited to side panels with diverging edges. For example, the first side panels 34*a*, 34*b* may be formed with side edges that extend parallel to the lateral edges 30, 32 of the bottom panel 24, and the second side panels 36*a*, 36*b* may be formed with side edges that extend parallel to the longitudinal edges 26, 28 of the bottom panel 24.

A pair of connection flaps $\mathbf{44}a_1$, $\mathbf{44}a_2$ are hingedly connected to respective opposing side edges $\mathbf{34}a_1$, $\mathbf{34}a_2$, of the first side panel 34*a*, and a pair of connection flaps $\mathbf{44}b_1$, $\mathbf{44}b_2$ are hingedly connected to opposing side edges $\mathbf{34}b_1$, $\mathbf{34}b_2$ of the first side panel 34*b*. The connection flaps $\mathbf{44}a_1$, $\mathbf{44}a_2$ include respective outer edges $\mathbf{46}a_1$, $\mathbf{46}a_2$, and the connection flaps $\mathbf{44}b_1$, $\mathbf{44}b_2$ include respective outer edges $\mathbf{46}b_1$, $\mathbf{46}b_2$.

A pair of first flange structures 48*a*, 48*b* are hingedly connected to the first side panels 34*a*, 34*b* at respective first flange fold lines 50*a*, 50*b* coinciding with the outer edges 37, 38 of the first side panels 34*a*, 34*b*. Each of the first flange fold lines 50*a*, 50*b* comprises a discontinuous fold line defined by two or more fold line segments $\mathbf{50}a_S$, $\mathbf{50}b_S$.

Each first flange structure 48*a*, 48*b* comprises a first flange portion 52 having a first edge coinciding with a respective first flange fold line 50*a*, 50*b*. The first flange portion 52 extends to one side of the first flange fold line 50*a*, 50*b*, i.e., located on a side of the first flange fold line 50*a*, 50*b* opposite from the bottom panel 24. Each first flange structure 48*a*, 48*b* further includes a second flange portion 54 extending to an opposite side of the first flange fold line 50*a*, 50*b* from the first flange portion 52. The second flange portion 54 is defined by one or more cut lines $\mathbf{54}_C$, wherein each cut line $\mathbf{54}_C$ extends from a respective first flange fold line 50*a*, 50*b* toward the bottom panel 24 and into an adjacent first side panel 34*a*, 34*b*, spanning between two adjacent fold line segments $\mathbf{50}a_S$, $\mathbf{50}b_S$, to form one or more tabs $\mathbf{54}_T$. It may be noted that, although the cuts $\mathbf{54}_C$ are illustrated as forming tabs $\mathbf{54}_T$ having a generally polygon shape, the present description is not limited to a particular shape for the tabs $\mathbf{54}_T$, and alternative shapes for the tabs $\mathbf{54}_T$ may be provided including, without limitation, curved shapes such as to form, e.g., semi-circular tabs $\mathbf{54}_T$.

The first flange portion 52 of each first flange structure 48*a*, 48*b* may be configured as a continuous structure having a second edge coinciding with a respective longitudinal end 16, 18 of the blank 10 and extending continuously between opposing side edges $\mathbf{34}a_1$, $\mathbf{34}a_2$ and $\mathbf{34}b_1$, $\mathbf{34}b_2$ of a respective first side panel 34*a*, 34*b*. The first flange portion 52 of each first flange structure 48*a*, 48*b* can include end portions or lateral extensions 53 at opposing ends of the first flange portion, extending along an outer fold line segment $\mathbf{50}a_S$, $\mathbf{50}b_S$, and may extend beyond the opposing side edges $\mathbf{34}a_1$, $\mathbf{34}a_2$ and $\mathbf{34}b_1$, $\mathbf{34}b_2$ of the respective first side panels 34*a*, 34*b*.

In some embodiments, the continuous structure of the first flange portion 52 can comprise at least a continuous section of material forming the flange structure 48*a*, 48*b* that extends along a portion of a first side panel 34*a*, 34*b* parallel to the first flange fold lines 50*a*, 50*b*, and is hingedly attached to a respective first side panel 34*a*, 34*b* via at least two successive fold line segments $\mathbf{50}a_S$, $\mathbf{50}b_S$ of the respective fold lines 50*a*, 50*b*, wherein the one or more tabs $\mathbf{54}_T$ each have a length dimension that is less than a length dimension of the first flange portion 52, extending parallel to the outer edges 37, 38 of the first side panels 34*a*, 34*b*. It may be understood that the first and second flange portions 52, 54 are integral with each other and define a continuous coplanar flange surface, wherein each first flange structure 48*a*, 48*b* straddles a respective first flange fold line 50*a*, 50*b*.

A pair of second flange structures 58*a*, 58*b* are hingedly connected to the second side panels 36*a*, 36*b* at respective second flange fold lines 60*a*, 60*b* coinciding with the outer edges 40, 42 of the second side panels 36*a*, 36*b*.

Each second flange structure 58*a*, 58*b* comprises a first flange portion 62 extending to one side of the second flange fold line 60*a*, 60*b*, i.e., located on a side of the second flange fold line 60*a*, 60*b* opposite from the bottom panel 24. Each second flange structure 58*a*, 58*b* further includes a second flange portion 64 extending to an opposite side of the second flange fold line 60*a*, 60*b* from the first flange portion 62. The second flange portion 64 of the second flange structure 58*a*, 58*b* can comprise tabs 64T located at opposing ends of the first flange portion 62 of the second flange structure 58*a*, 58*b*, wherein the tabs 64T extend from the second flange fold line 60*a*, 60*b* toward upper side edges 65 of respective second side panels 36*a*, 36*b*, i.e., in a direction toward the bottom panel 24.

As illustrated herein, the first flange portion 62 of each second flange structure 58*a*, 58*b* may be configured as a continuous structure extending between opposing side edges $\mathbf{36}a_1$, $\mathbf{36}a_2$ and $\mathbf{36}b_1$, $\mathbf{36}b_2$ of a respective second side panel 36*a*, 36*b*. The tabs $\mathbf{64}_T$ each have a length dimension that is less than a length dimension of the first flange portion 52, extending parallel to the outer edges 40, 42 of the second side panels 36*a*, 34*b*. It may be understood that the first and second flange portions 62, 64 are integral with each other and define a continuous coplanar flange surface, wherein each second flange structure 58*a*, 58*b* straddles a respective second flange fold line 60*a*, 60*b*.

Each of the connection flaps $\mathbf{44}a_1$, $\mathbf{44}a_2$, $\mathbf{44}b_1$, $\mathbf{44}b_2$ can include a support flange 66 hingedly connected to the connection flaps $\mathbf{44}a_1$, $\mathbf{44}a_2$, $\mathbf{44}b_1$, $\mathbf{44}b_2$ at support flange fold lines 68 coinciding with the respective outer edges $\mathbf{46}a_1$, $\mathbf{46}a_2$, $\mathbf{46}b_1$, $\mathbf{46}b_2$. Each of the support flange fold lines 68 can include an end adjacent to an end of one of the first flange fold lines 50*a*, 50*b*. Each support flange 66 comprises a first flange portion 70 extending along the support flange fold line 68 outward from the connection flap 44$a_1$, 44$a_2$, 44$b_1$, 44$b_2$, and a second flange portion 72 comprising at least one tab 72T defined by a cut line 72*c* in a respective connection flap 44$a_1$, 44$a_2$, 44$b_1$, 44$b_2$ and integral with the first flange portion 70 of the support flange 66. It may be understood that the first and second flange portions 70, 72 of each support flange 66 are integral with each other and define a continuous coplanar flange surface, wherein each support flange 66 straddles a respective support flange fold line 68.

Referring to FIGS. 1 and 2, in a use of the blank 10 to form a container 8, the first and second side panels 34*a*, 34*b* and 36*a*, 36*b* are pivoted upward relative to the bottom panel 24 at the respective longitudinal and lateral edges 26, 28 and 30, 32 to form a plurality of peripheral side walls. In particular, the bottom panel 24 comprises a planar bottom portion forming a base for the container 8, and opposing first and second side walls 74, 76 are formed by the first side panels 34*a*, 34*b*. Opposing third and fourth side walls 78, 80 extend between the first and second side walls 74, 76. The third and fourth side walls 78, 80 and are formed by the connection flaps 44$a_1$, 44$b_1$ and 44$a_2$, 44$b_2$, comprising inner flaps, pivoted generally perpendicular to the first side panels 34*a*, 34*b* and adhered to interior surfaces of the respective second side panels 36*a*, 36*b*. It may be understood that the diverging edges 34$a_1$, 34$a_2$, 34$b_1$, 34$b_2$ provide a tapered configuration for the side walls 74, 76, 78, 80 of the container 8, such as to define a punnet container having an interior area 11 for receiving a product.

Figure 3:
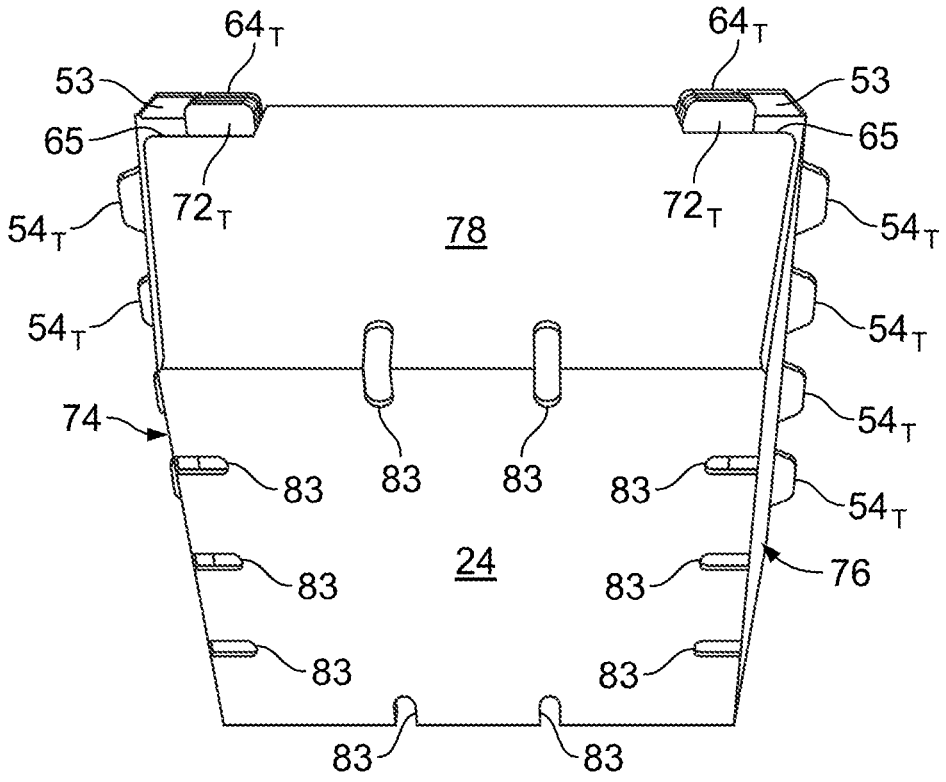
FIG. 3 is bottom perspective view of the container of FIG. 2.
Figure 4:
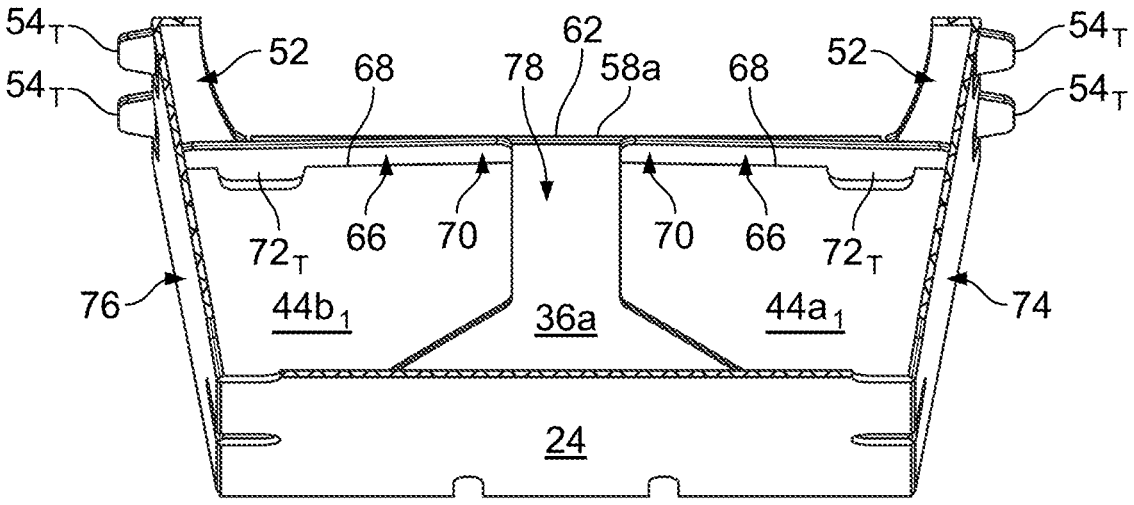
FIG. 4 is a cross-sectional perspective view illustrating an inner end of the container of FIG. 2.

Referring to FIGS. 3 and 4, the support flanges 66 on the connection flaps 44$a_1$, 44$a_2$, 44$a_3$, 44$a_4$ can be pivoted about the support flange fold lines 68, wherein the first flange portions 70 can be pivoted inward, extending perpendicular to the third and fourth side walls 78, 80 over the interior area 11 of the container 8. Simultaneous with pivoting of the first flange portions 70 inward, the tabs 72$_T$ pivot outward extending from the connection flaps 44$a_1$, 44$a_2$, 44$b_1$, 44$b_2$ and outwardly beyond the side walls 78, 80 at locations above the upper side edges 65.

Referring to FIG. 2, the second flange structures 58*a*, 58*b* on the second side panels 36*a*, 36*b* can be pivoted about the second flange fold lines 60*a*, 60*b*, wherein the first flange portions 62 can be pivoted inward, extending perpendicular to the third and fourth side walls 78, 80, to define an inner flange portion extending over the interior area 11 of the container 8. Simultaneous with pivoting of the first flange portions 62 inward, the second flange portions 64, i.e., the tabs 64$_T$, pivot outward to extend outwardly beyond the third and fourth side walls 78, 80 to define an outer flange portion. The first and second flange portions 62, 64 of the second flange structures 58*a*, 58*b* straddle the third and fourth side walls 78, 80. Pivoting of the second flange structures 58*a*, 58*b* positions the first flange portions 62 of the second flange structures 58*a*, 58*b* to at least partially overlap and engage the first flange portions 70 of the support flanges 66, see FIG. 4, and the tabs 64$_T$ can be positioned to at least partially overlap and engage the tabs 72$_T$ on the support flanges 66, see FIG. 3, wherein at least a portion of the second flange structures 58*a*, 58*b* can be adhered to upward facing surfaces of a respective support flange 66.

Referring to FIG. 2, the first flange structures 48*a*, 48*b* on the first side panels 34*a*, 34*b* can be pivoted about the first flange fold lines 50*a*, 50*b*, wherein the first flange portions 52 can be pivoted about the hinge sections 50$a_S$, 50$b_S$ in an inward direction, and extending perpendicular to the first and second side walls 74, 76, to define an inner flange portion extending over the interior area 11 of the container 8. Simultaneous with pivoting of the first flange portions 52 inward, the second flange portions 54, i.e., the tabs 54$_T$, separate from the first side panels 34*a*, 34*b* at the cut lines 54*c* and pivot outward to extend outwardly beyond the first and second side walls 74, 76, to define an outer flange portion, such that the first and second flange portions 52, 54 of the second flange structures 48*a*, 48*b* straddle the first and second side walls 74, 76. Pivoting of the first flange structures 48*a*, 48*b* can position the lateral extensions 53 of the first flange portions 52 to at least partially overlap and engage the tabs 72$_T$ and the first flange portion 70 on the support flanges 66, see FIGS. 3 and 4, wherein at least a portion of the lateral extensions 53 can be adhered to upward facing surfaces of a respective support flange 66.

The first flange portions 52, 62 and second flange portions 54, 64 of the first and second flange structures 48*a*, 48*b* and 58*a*, 58*a* are substantially coplanar with each other and form a sealing flange 84 at an upper edge of the container 8, i.e., at an upper edge defined by the outer edges 37, 38 and 40, 42 of the first side panels 34*a*, 34*b* and 36*a*, 36*b*.

It may be noted that as the tabs 54$_T$, separate from the first side panels 34*a*, 34*b* at the cut lines 54$_C$, openings or vents 82 are formed in the first and second side walls 74, 76 that can provide for passage of air between the exterior and interior of the container 8. Additional vent openings 83 can be provided extending between the bottom panel 24 and the side walls 74, 76, 78, 80, as seen in FIGS. 2 and 3.

Figure 5:
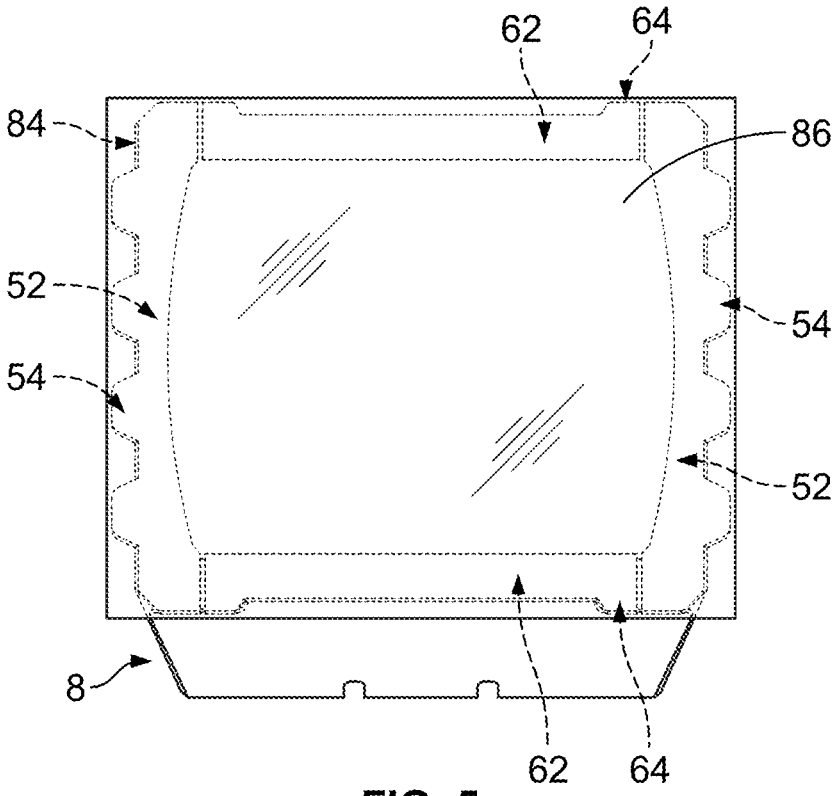
FIG. 5 is a perspective view of the container of FIG. 2 with a seal film attached to a sealing flange of the container.

The second flange portions 54, 64 defined by the tabs 54$_T$, 64$_T$ can provide a support structure for the contain 8 in a production process for filling and sealing the container 8. In particular, a use of the container 8 may include positioning the container within a cavity surrounded by a peripheral support surface (not shown) defining a platen for supporting the container 8 during placement of a seal 86 on the sealing flange 84, see FIG. 5. For example, the seal 86 may comprise a plastic sheet or film that is heat sealed to the upward facing surface of the sealing flange 84. The seal can be attached to the first flange portions 52, 62, as well as to the second flange portions 54, 64, wherein attachment to the first flange portions 52, 62 can prevent a pivoting of the flange structures 48*a*, 48*b*, 58*a*, 58*b* downward toward the interior 11 of the container 8, such that a tension can be maintained on the seal 86 spanning the interior 11 of the container 8 to maintain the seal substantially without wrinkles as it spans the interior 11 of the container 8. The tabs 54$_T$, 64$_T$ provide a supported portion of the sealing flange 84 that can be positioned between a supporting platen (not shown), engaged from below, and an iron (not shown) engaged from above, for sealing the film forming the seal 86. Hence, the present container describes a means of providing a practical inward folding flange and opposing tabs that straddle a fold line on the top edge of the container to form outward projections to support the container during sealing with top film.

The tabs 54$_T$, 64$_T$ may be dimensioned with a width that is less than a width of the respective first portion 52, 54 so as to provide a sufficient tab width, in a direction perpendicular to a respective side wall, to support the container 8 at the edge of a cavity for receiving the container in a production process, while reducing or minimizing the outward extension of the tabs 54$_T$, 64$_T$. In particular, as depicted in FIG. 1 with reference to a tab 54$_T$ of the first flange structure 48*a*, the tab 54$_T$ has a width dimension $W_1$ that is less than a width dimension $W_2$ of an adjacent section of the first flange portion 52, such that a more substantial width may be provided to the first flange portion 52 for attachment to the seal 86 as compared to the width of the respective tab $54_T$. The straddle structure enables the width $W_1$ of the tab $54_T$ to be minimized by forming it at a location on the flange structure 48*a* that is displaced from the fold line segments $50a_S$.

It should be noted that an inner edge of the sealing flange 84 as defined along the innermost edge of the first flange structures 48*a*, 48*b* may be formed with a shape, e.g., a curve, that varies the width of the sealing flange 84, and that the width $W_2$ of the first flange portion 52 can approach the width of a respective tab $54_T$.

Although the seal 86 is described with reference to a plastic film, it may be understood that other materials or configurations for the seal may be provided. For example, and without limitation, a three-dimensional preformed lid (not shown) may be provided as a seal 86, or a metal foil or other material may be provided as a seal.

Further, although the sealing flange 84 is described as fully surrounding the periphery of the container 8, it should be understood that aspects of the described container 8 can include fewer flange features. For example, the container 8 may be provided with only the first flange structures 48*a*, 48*b* to define flanges at two opposing sides of the container 8, which may provide a sufficient sealing surface for attachment of a seal 86. Alternatively, the first and second flange structures 48*a*, 48*b* and 58*a*, 58*b* may be provided without the support flanges 66, wherein the straddle flanges formed by the first and second flange structures 48*a*, 48*b* and 58*a*, 58*b* may be maintained in position by attachment of the seal 86 to the upper surfaces of the flange portions 52, 54 and 62, 64.

Also, while a punnet container configuration has been described for the container 8, it should be understood that aspects described for forming a seal at an upper edge of the container 8 may implemented with other container configurations, including containers having non-tapered or perpendicular walls.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container comprising:

a bottom panel defining a base of the container;

a plurality of side walls extending from the bottom panel and defining an interior area of the container, the plurality of side walls including at least opposing first and second side walls and opposing third and fourth side walls extending between the first and second side walls;

an upper edge of the container defined by edges of the plurality of the side walls distal from the bottom panel;

a first flange structure having a length and connected to each of the first and second side walls along respective fold lines at the upper edge of the container;

each first flange structure straddling a respective side wall and comprising an inner flange portion extending over the interior area of the container, and an outer flange portion, coplanar with the inner flange portion, extending away from the interior of the container, the outer flange portion defined by one or more tabs having a length dimension, parallel to the first and second side walls, that is less than a length dimension of the inner flange portion;

a second flange structure hingedly attached to each of the third and fourth side walls at the upper edge of the container, each second flange structure including an inner flange portion extending over the interior area of the container and an outer flange portion extending away from the interior area of the container; and connection flaps hingedly connected to opposing lateral sides of each of the first and second side walls at fold lines and adhered to respective ones of the third and fourth side walls, and a support flange hingedly connected to each of the connection flaps and engaged under a respective inner flange portion of one of the second flange structures.

2. The container as set forth in claim 1, wherein each inner flange portion includes a first edge hingedly attached to a respective one of the first and second side walls at two or more spaced fold line segments defining the fold lines, and a second edge extending continuously along the length of the first flange structure and located over the interior area of the container.

3. The container as set forth in claim 2, wherein the one or more tabs extend from the first edge of the inner flange portion at locations between the fold line segments.

4. The container as set forth in claim 3, wherein each inner flange portion has a width dimension, extending in a transverse direction perpendicular to the first and second side walls, that is greater than a width dimension of the outer flange portion, extending in the transverse direction.

5. The container as set forth in claim 1, wherein the outer flange portions of the second flange structures each comprise tabs that extend away from the interior area of the container and that have a length dimension parallel to the third and fourth side walls that is less than a length dimension of the first flange portions.

6. The container as set forth in claim 1, wherein each support flange includes a tab extending away from the interior area of the container and engaged under a respective outer flange portion of one of the second flange structures.

7. The container as set forth in claim 1, wherein the first flange structures include lateral extensions that are engaged over a respective support flange.

8. A container formed of a unitary blank of semi-rigid material, the container comprising:

a bottom panel defining a base of the container;

a plurality of side walls comprising opposing first and second side walls connected to the bottom panel and opposing third and fourth side walls connected to the bottom panel; an upper edge of the container defined by edges of the plurality of the side walls distal from the bottom panel;

a first flange structure connected to each of the first and second side walls along respective fold lines at the upper edge of the container;

a second flange structure connected to each of the third and fourth side walls along respective fold lines at the upper edge of the container;

each of the first and second flange structures straddling a respective side wall and comprising an inner flange portion extending over the interior area of the container, and an outer flange portion, coplanar with the inner flange portion, extending away from the interior of the container; and connection flaps hingedly connected to opposing lateral sides of each of the first and second side walls at fold lines and adhered to respective ones of the third and fourth side walls, and a support flange hingedly connected to each of the connection flaps and engaged under both one of the first flange structures and one of the second flange structures.

9. The container as set forth in claim 8, wherein the outer flange portion of each of the first and second flange structures is defined by one or more tabs having a length dimension, parallel to a respective side wall, that is less than a length dimension of the inner flange portion.

10. The container as set forth in claim 9, wherein the inner flange portion of each of the first and second flange structures is defined by a continuous flange extending between opposing side edges of a respective side wall.

11. The container as set forth in claim 8, including one or more vent openings in the first and second side walls, wherein each vent opening is formed by a cut line defining a respective tab that is separated from a respective first and second side wall during a pivoting of the first and second flange structures to a position perpendicular to the first and second side walls.

12. The container as set forth in claim 8, wherein an upper surface of the first flange structure is coplanar with an upper surface of the second flange structure.

13. A blank for forming a container, the blank comprising:

a bottom panel a having opposing longitudinal edges, and opposing lateral edges;

a pair of first side panels hingedly connected to the bottom panel at the longitudinal edges;

a pair of second side panels hingedly connected to the bottom panel at the lateral edges;

a first flange structure hingedly connected to each of the first side panels at respective first flange fold lines, each first flange fold line comprising a discontinuous fold line defined by two or more fold line segments;

each first flange structure including a first flange portion extending to one side of the first flange fold line and second flange portion extending to an opposite side of the first flange fold line and wherein the first flange portion of the first flange structure is continuous extending between opposing sides of a respective first side panel;

a second flange structure hingedly connected to each of the second side panels at respective second flange line fold lines;

each second flange structure including a first flange portion extending to one side of the second flange fold line and a second flange portion extending to an opposite side of the second flange fold line;

wherein each of the first side panels includes opposing sides that diverge extending in a direction from the bottom panel, and each of the second side panels includes opposing sides that diverge extending in a direction from the bottom panel and wherein the second flange portion of the first flange structure comprises at least one cut line defined in each of the first side panels and spanning between adjacent fold line segments to define at least one tab integral with the first flange portion of the first flange structure.

14. The blank as set forth in claim 13, including cut lines defined in each of the first side panels and spanning between each of a plurality of adjacent fold line segments to define a plurality of tabs integral with the first flange portion of the first flange structure.

15. The blank as set forth in claim 13, wherein the first flange portion of the second flange structure is continuous extending along the second flange fold line, and the second flange portion of the second flange structure comprises tabs located at opposing ends of the first flange portion of the second flange structure, the tabs extending from the second flange fold line toward a respective second side panel.

16. The blank as set forth in claim 13, including connection flaps hingedly connected to opposing sides of each of the first side panels at fold lines, and a support flange hingedly connected to each of the connection flaps at a support flange fold line and wherein each support flange fold line includes an end adjacent to an end of a first flange fold line, and each support flange comprises a first portion extending along the support flange fold line outward from the connection flap, and a second flange portion comprising at least one tab defined by a cut line in the connection flap and integral with the first flange portion of the support flange.

* * * * *